US006955364B2

(12) United States Patent
Dyson et al.

(10) Patent No.: US 6,955,364 B2
(45) Date of Patent: Oct. 18, 2005

(54) STEERING OR LIFTING MECHANISM

(75) Inventors: James Dyson, Little Somerford (GB); Paul Richard Sandom, Worcester Park (GB)

(73) Assignee: Dyson Limited, Wiltshire (GB)

( * ) Notice: Subject to any disclaimer, the term of this patent is extended or adjusted under 35 U.S.C. 154(b) by 0 days.

(21) Appl. No.: 10/220,196

(22) PCT Filed: Feb. 21, 2001

(86) PCT No.: PCT/GB01/00714

§ 371 (c)(1),
(2), (4) Date: Dec. 3, 2002

(87) PCT Pub. No.: WO01/71086

PCT Pub. Date: Sep. 27, 2001

(65) Prior Publication Data

US 2005/0098968 A1 May 12, 2005

(30) Foreign Application Priority Data

Mar. 18, 2000 (GB) ..... 0006490

(51) Int. Cl.[7] ..... B62B 1/00
(52) U.S. Cl. ..... 280/43; 280/46; 280/43.17
(58) Field of Search ..... 280/47.12, 47.17, 280/47.3, 47.32, 43, 46, 43.14, 43.17, 43.2, 280/43.24; 16/32, 33

(56) References Cited

U.S. PATENT DOCUMENTS 2,358,007 A * 9/1944 Henley ..... 16/32

(Continued)

FOREIGN PATENT DOCUMENTS

DE 196 51 291 A1 6/1998
EP 0 207 843 A1 1/1987

(Continued)

*Primary Examiner*—Christopher P. Ellis
*Assistant Examiner*—Brian Swenson
(74) *Attorney, Agent, or Firm*—Morrison & Foerster LLP

(57) ABSTRACT

The invention provides a mechanism suitable for lifting an appliance, particularly a domestic appliance. The mechanism (2) comprises a generally cylindrical body (8) having a wall (50) and a longitudinal axis (16) which extends in an upward direction. At least one rolling support member (20) is rotatably mounted on an axle (100) beneath the body (8). A housing (6) having a generally cylindrical socket portion (200) with an inner surface (208) receives the body (8). The wall (50) and the inner surface (208) incorporate opposing camming surfaces (62) (210) such that when the body (8) is rotated about the axis (16) with respect to the socket portion (200), the camming surfaces (62) (210) co-operate. The housing (6) is moved axially with respect to the body (8) and away from the at least one rolling support member (20). The mechanism (2) lifts the appliance (400) from a resting position and into an elevated position ready for manoeuvring. The invention further provides a mechanism (2) suitable for steering an appliance (400). The mechanism (2) comprises a housing (6) and a body (8). The body (8) is connected to the housing (6) so as to allow relative rotation therebetween about a vertical axis (16). At least one rolling support member (20) is mounted on a horizontal axle (100), the axle (100) being mounted on the body (8) and located so as to intersect the vertical axis (16). A handle portion (10) is connected to the body (8) and extends radially outwardly from the vertical axis (16). This arrangement allows the consumer to steer the appliance (400) in an elevated position, in a range of directions, including but not limited to forwards and backwards.

26 Claims, 6 Drawing Sheets

U.S. PATENT DOCUMENTS

| | | | | | |
|---|---|---|---|---|---|
| 2,874,971 | A | * | 2/1959 | Devery | 280/46 |
| 3,441,974 | A | * | 5/1969 | Dean | 16/33 |
| 3,480,292 | A | * | 11/1969 | Borkey | 280/43.17 |
| 3,844,578 | A | * | 10/1974 | Matyskella et al. | 280/43.22 |
| 5,010,969 | A | * | 4/1991 | Hirmann | 180/8.1 |

FOREIGN PATENT DOCUMENTS

| | | |
|---|---|---|
| EP | 0 812 947 A1 | 6/1996 |
| GB | 1 478 998 | 7/1977 |
| GB | 2 360 203 | 9/2001 |
| WO | 98/48097 | 10/1998 |

* cited by examiner

STEERING OR LIFTING MECHANISM

The invention relates to a steering or lifting mechanism. The invention relates, particularly but not exclusively, to a steering or lifting mechanism suitable for use in appliances, for example, domestic appliances. The invention further relates to domestic appliances, particularly washing machines, incorporating the steering or lifting mechanism.

Manufacturers do not generally recommend that domestic appliances, more specifically washing machines, tumble dryers, refrigerators or freezers, be frequently moved. This is particularly important for washing machines which, in use, need to stand stably on fixed feet. This is because the inevitable uneven distribution of the laundry load during the spinning cycle causes an imbalance in the drum. Any vibrations of the machine resulting from this must be compensated for so as to prevent the machine from moving or 'walking' across the floor. However, on occasions, the appliance may need to be moved, for example when the consumer wishes to clean the area around or behind the machine. This is often difficult as these types of domestic appliances are generally heavy and cannot easily be manoeuvred. To overcome this problem, retractable castors can be fitted to the base of the appliance. An example of this is shown in EP 0,207,843 which discloses a washing machine having a supporting base with retractable castors. The castors are mounted on a common axle that can be actuated by means of a lever. The axle is movable so as to cause the castors to drop from a retracted position in which the washing machine rests on its fixed feet on the floor, to a lowered position in which the castors contact the floor and the fixed feet are raised. In the lowered position, the consumer is able to move the machine either by pushing it from the rear or by pulling the front housing. This type of arrangement is limited to movement in a forward or backward direction which makes manoeuvring the machine troublesome.

It is an object of the present invention to provide a steering or lifting mechanism which gives the consumer greater manoeuvrability of an appliance. It is a further object of the invention to provide an improved mechanism for lifting the appliance from a resting position and into an elevated position ready for manoeuvring. Still further it is an object of the present invention to provide an appliance incorporating an improved lifting and/or steering mechanism.

In a first aspect, the invention provides a steering mechanism for an appliance comprising: a housing and a body, the body being connected to the housing so as to allow relative rotation therebetween about a vertical axis; at least one rolling support member mounted on a horizontal axle, the axle being mounted on the body and located so as to intersect the vertical axis; and a handle portion connected to the body and extending radially outwardly from the vertical axis. This arrangement provides improved manoeuvrability of the appliance. The mechanism allows the consumer to steer the appliance in a range of directions, including backward and forward.

Preferably, the axle is located so as to lie perpendicular to the radial direction in which the handle portion extends. This configuration enables the rolling support member to follow the direction in which the handle portion is being pulled. More preferably, the handle portion extends in a horizontal direction. This arrangement allows the mechanism to be conveniently stored in the appliance. Further, the handle portion has a gripping portion located at the distal end thereof and spaced from the body in the radial direction in which the handle portion extends. Provision of the gripping portion enables the consumer to hold the mechanism in a convenient manner.

In a second aspect, the invention provides a lifting mechanism for an appliance comprising: a generally cylindrical body having a wall and a longitudinal axis, the axis extending in an upward direction; at least one rolling support member rotatably mounted on an axle beneath the body; and a housing having a generally cylindrical socket portion with an inner surface for receiving the body, wherein the wall and the inner surface incorporate opposing camming surfaces such that, when the body is rotated about the axis with respect to the socket portion, the camming surfaces cooperate so as to move the housing axially with respect to the body and away from the at least one rolling support member. This arrangement provides an improved means for lifting the appliance from a stable position and into an elevated position ready for manoeuvring. Further, the arrangement is relatively simple and easy to construct making it an inexpensive feature to incorporate into the appliance.

Preferably, a peg is located on the housing and projects into the interior of the socket portion, along the axis. More preferably, the body has an aperture located at an upper end thereof for receiving the peg. Cooperation of the peg with the aperture ensures the correct alignment of the housing with the body.

In a third aspect, the invention provides an appliance incorporating a steering or lifting mechanism as described above.

An embodiment of the invention will now be described, by way of example only, with reference to the accompanying drawings, wherein.

Figure 8:
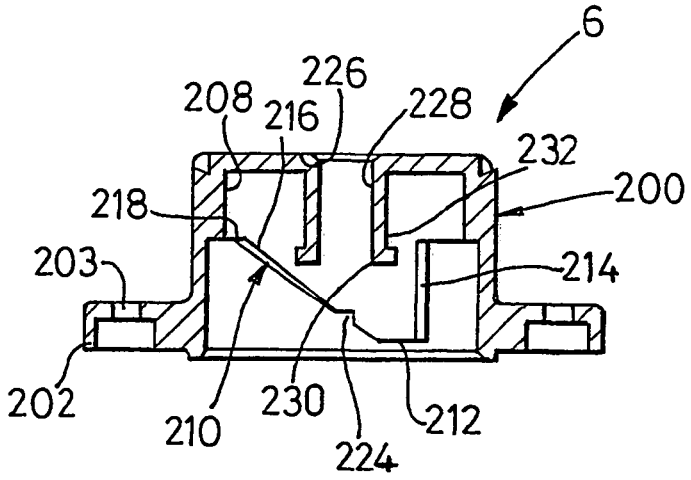
FIG. 8 is a sectional view of the housing shown in FIG. 7.
Figure 9:
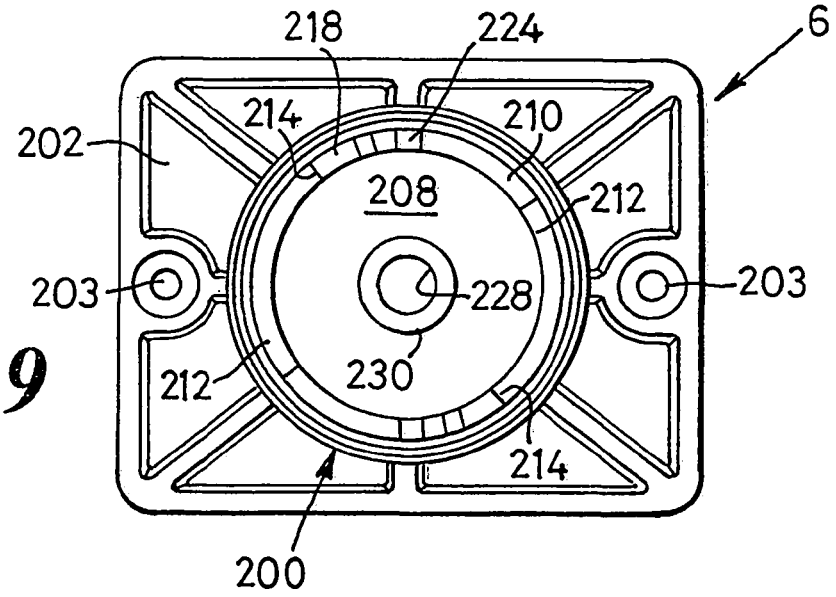
FIG. 9 is an underneath view of the housing shown in FIGS. 7 and 8.
Figure 10A:
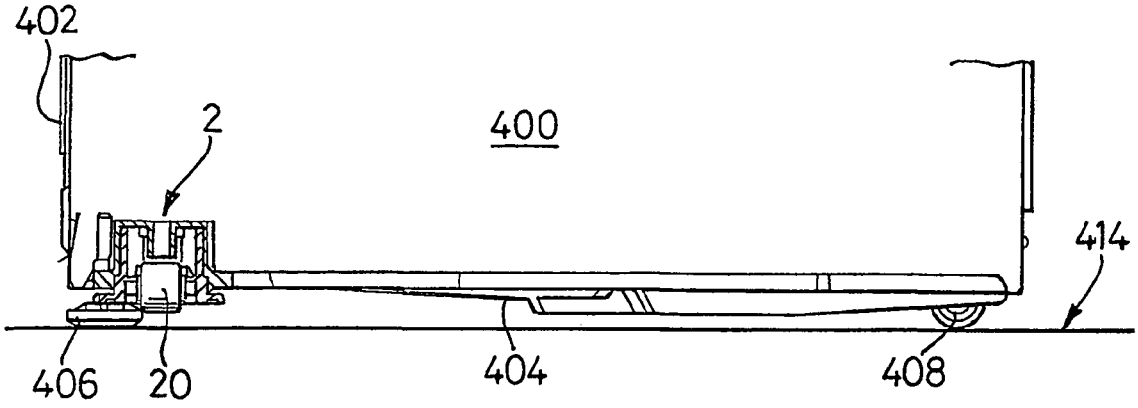
Figure 10B:
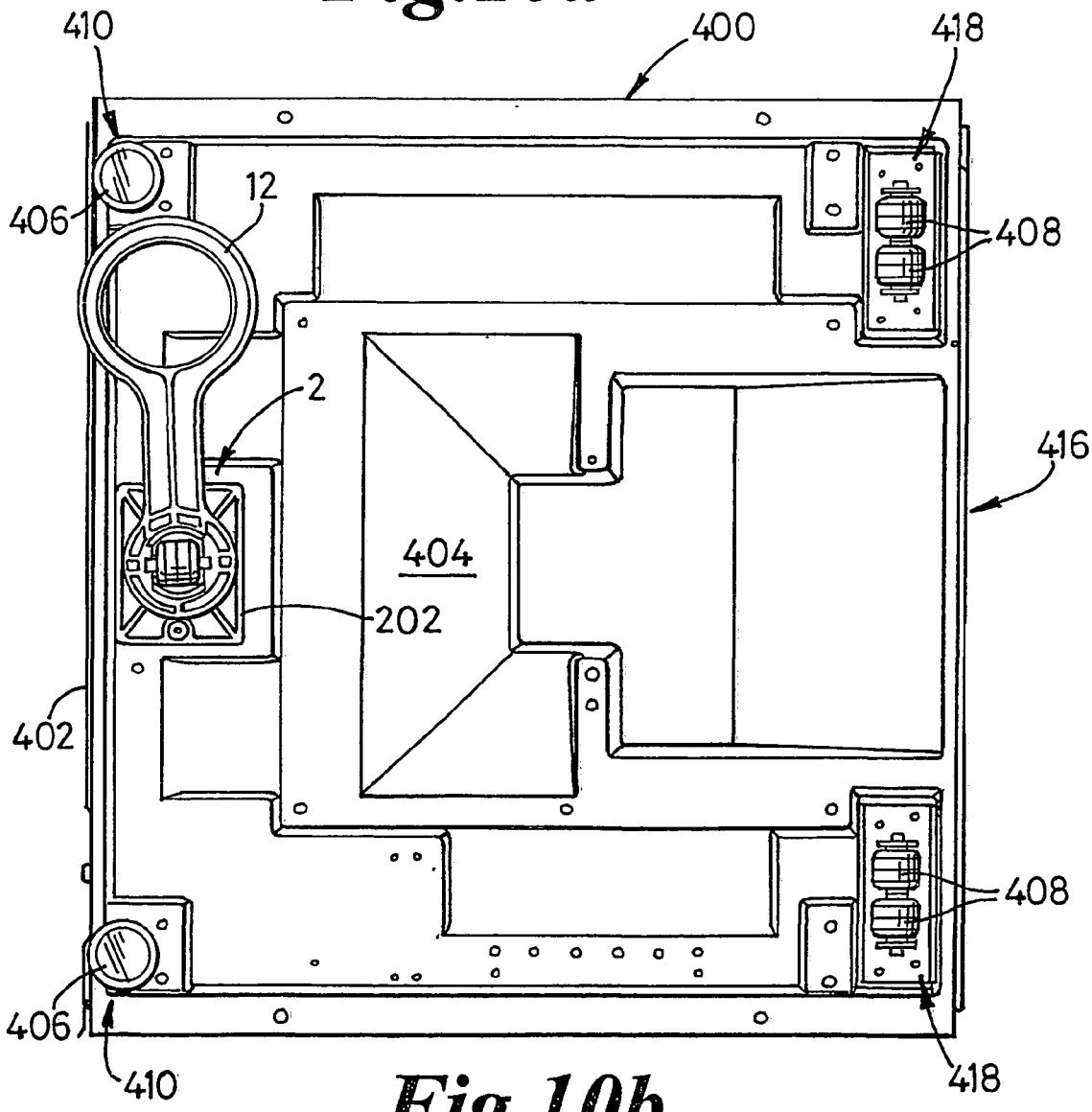
Figure 11A:
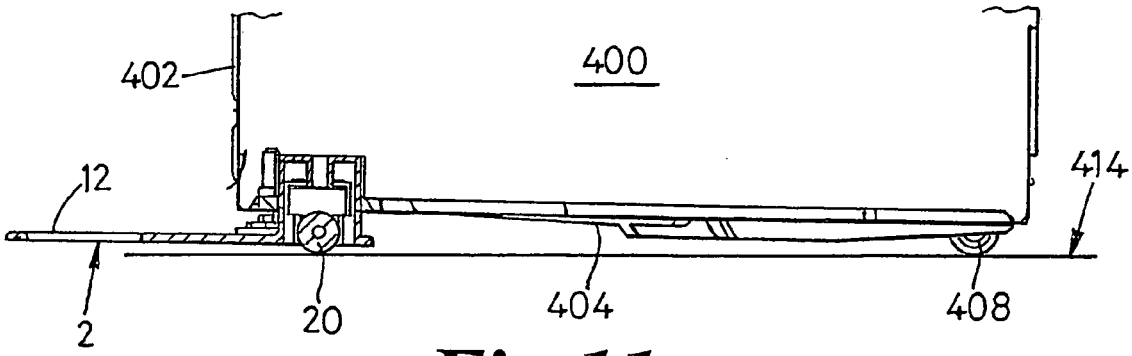
Figure 11B:
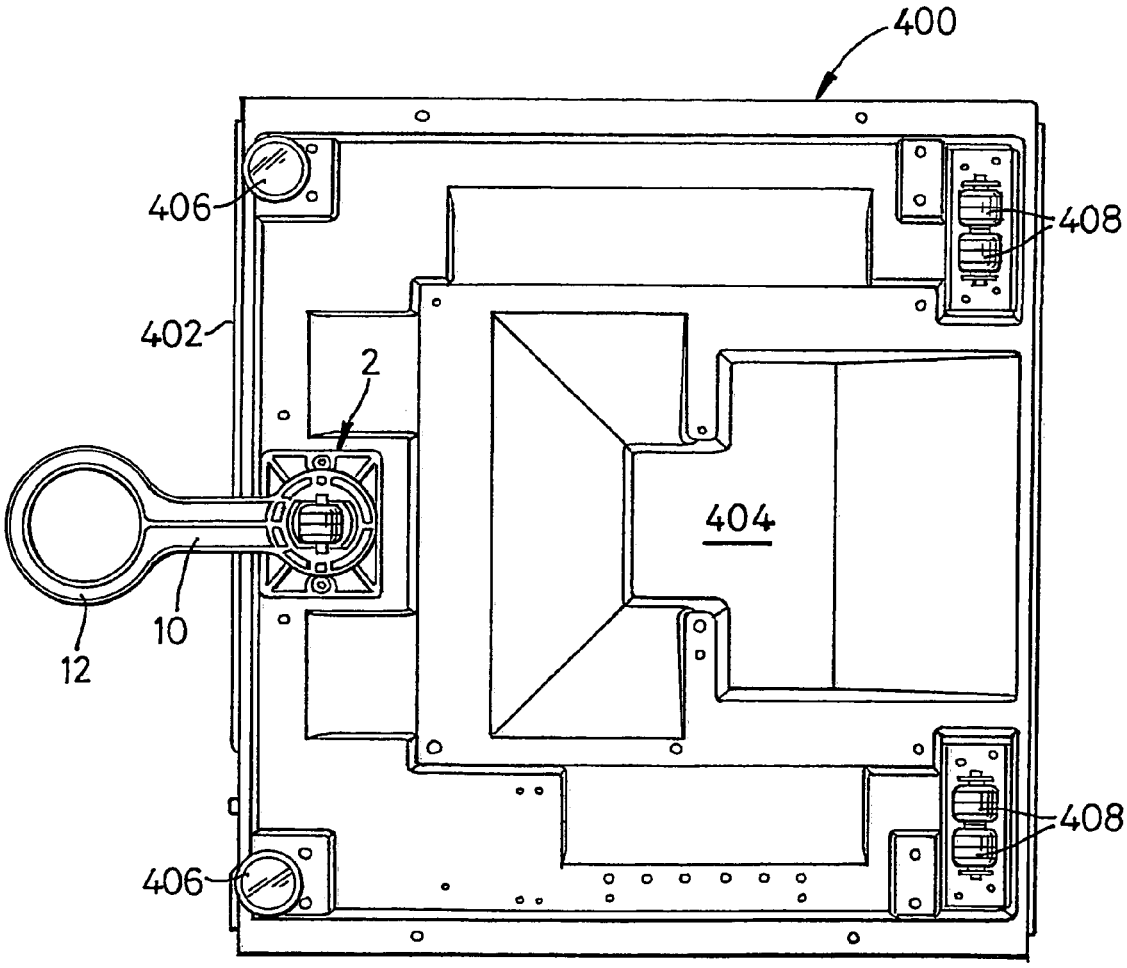

FIGS. 10*a* and 10*b* show respectively a side view and an underneath view of a washing machine incorporating the mechanism of FIGS. 1 to 9 in a first position; and FIGS. 11*a* and 11*b* show respectively a side view and an underneath view of a washing machine incorporating the mechanism of FIGS. 1 to 9 in a second position.

Figure 1:
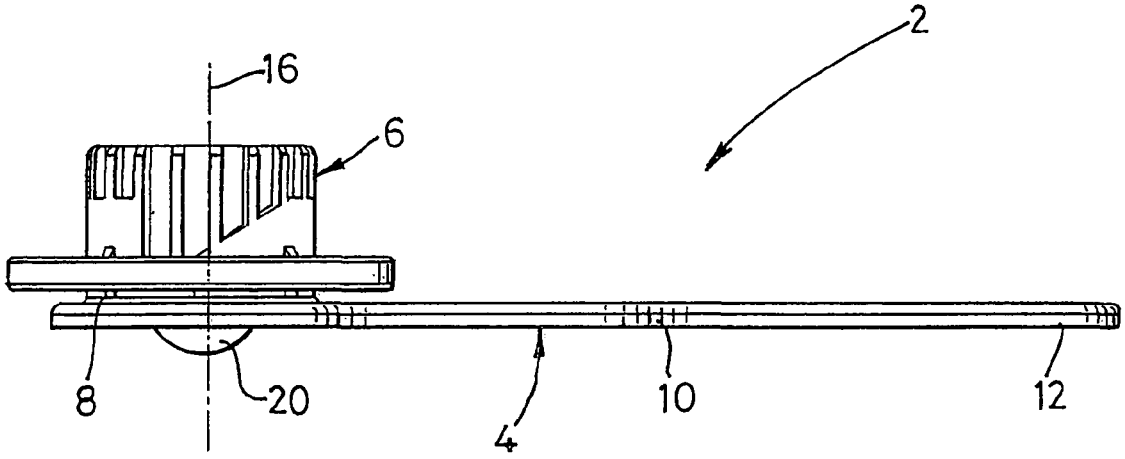
FIG. 1 is a side view of a steering or lifting mechanism according to the invention shown in a first position.
Figure 2:
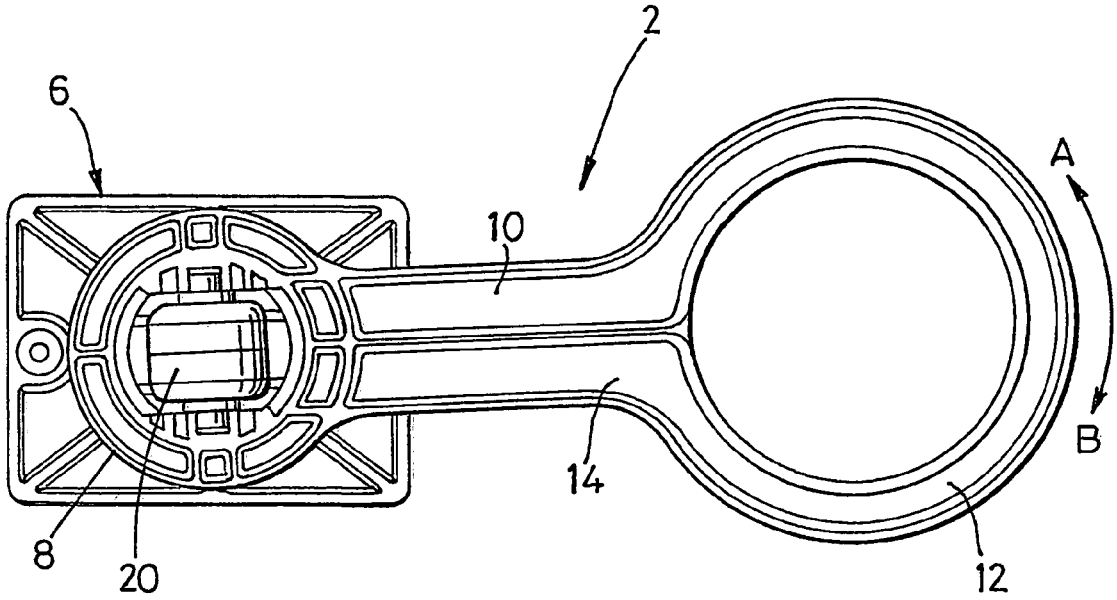
FIG. 2 is an underneath view of the mechanism of FIG. 1.

FIGS. 1 and 2 show a mechanism 2 which can be used in an appliance. The mechanism 2 has two distinct capabilities, to lift the appliance into a position where it can be manoeuvred and to steer the appliance in the desired direction. The mechanism 2 has a body portion 4 and a housing 6. The body portion 4 has a body 8 and a handle portion 10. A gripping portion 12 is located at an end 14 of the handle portion 10 remote from the body 8. The body 8 is generally cylindrical and has a longitudinal axis 16. The housing 6 is coaxial with the body 8. The housing 6 receives the body 8 therein. The housing 6 is rotatable about the axis 16 with respect to the body portion 4 so as to cause relative movement of the housing 6 and the body 8 along the axis 16 as will hereinafter be described. A rolling support member 20 is mounted beneath the body 8 to provide steerable movement as will be described below.

Figure 3:
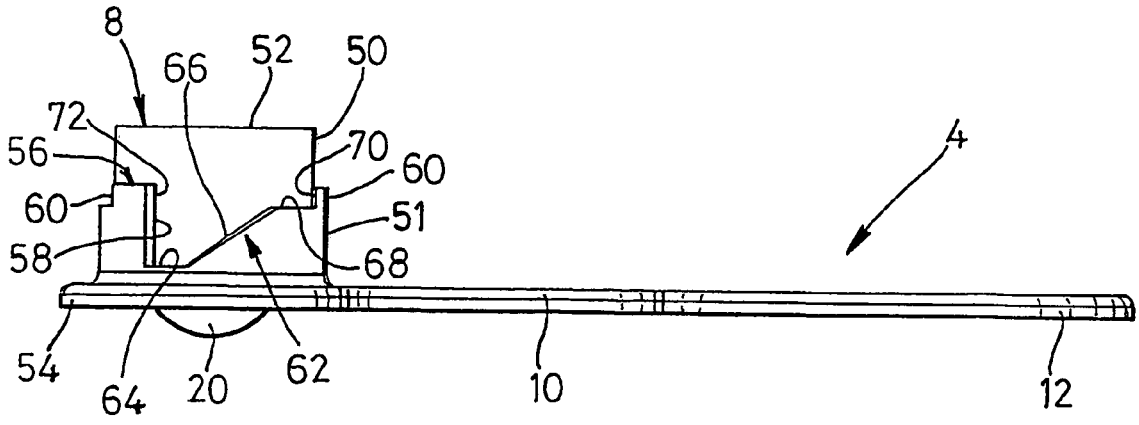
FIG. 3 is a side view of a body portion forming part of the mechanism of FIGS. 1 and 2.
Figure 4:
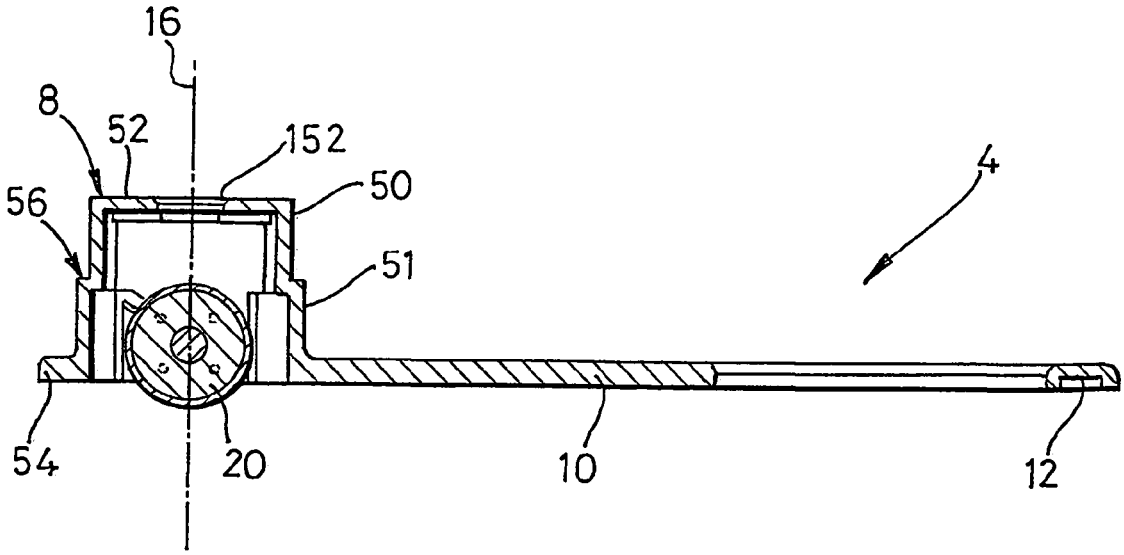
FIG. 4 is a sectional view of the body portion shown in FIG. 3.

The body portion 4 is shown in greater detail in FIGS. 3 to 6. The body 8 has a generally cylindrical wall 50, an upper face 52 and a base portion 54. The wall 50 has an enlarged lower portion 51 having shapings 56 formed in an upper part thereof as shown in FIG. 3. The shapings 56 are diametrically symmetrical and comprise two identical sets of shapings 56 provided about the circumference of the body 8. Each set of shapings 56 comprises an abutment edge 58 extending parallel to the axis 16, a stop 60 and a camming surface 62 located between the abutment edge 58 and the stop 60. The camming surface 62 has a first flat portion 64 which extends circumferentially from the abutment edge 58 to an inclined portion 66. The inclined portion 66 extends upwardly from the first flat portion 64 at an angle of substantially 40° to the base portion 54. The inclined portion 66 extends to a second flat portion 68. The second flat portion 68 extends circumferentially around the wall 50 from the inclined portion 66 to adjoin a stop face 70 of the stop 60. The stop 60 is generally rectangular in side view and extends upwardly from the second flat portion 68. An edge 72 of the stop 60 remote from the stop face 70 is in register with the abutment edge 58.

Figure 5:
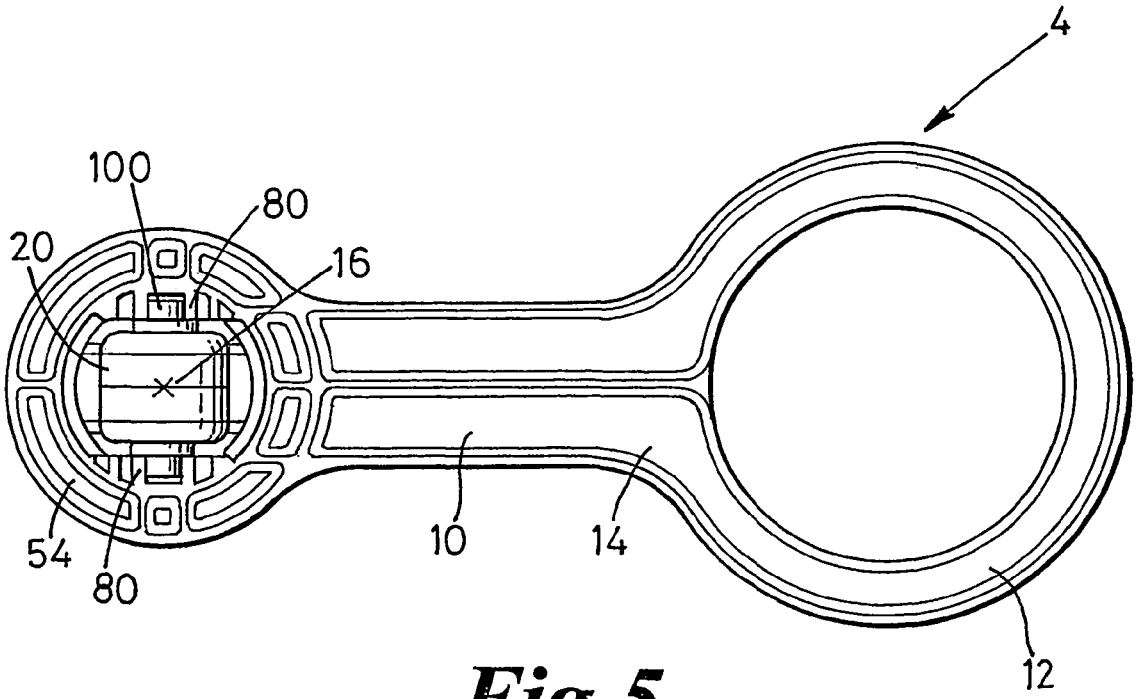
FIG. 5 is an underneath view of the body portion shown in FIGS. 3 and 4.
Figure 6:
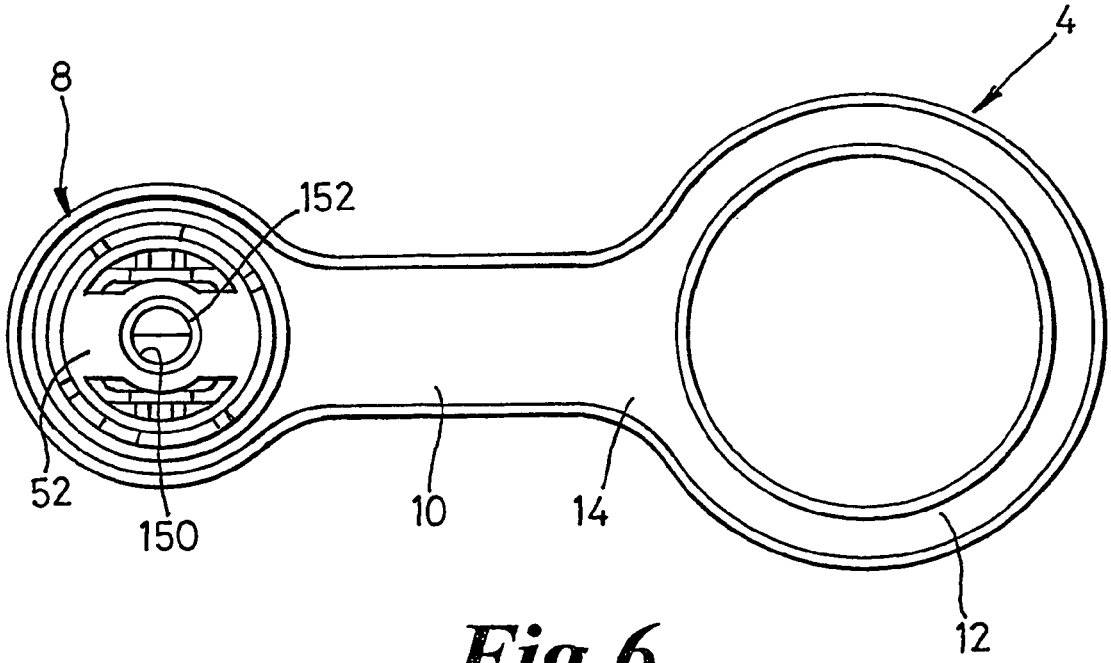
FIG. 6 is a plan view of the body portion shown in FIGS. 3 to 5.

The base portion 54 is generally circular in plan view as shown in FIGS. 5 and 6. Lugs 80 are provided in the base portion 54 for locating and securing an axle 100. The axle 100 can be fixedly held between the lugs 80 by adhesive, welding, snap-fit or any other convenient means. The axle 100 is located so as to lie perpendicular to the axis 16. The rolling support member 20 is freely rotatably mounted on the axle 100 between the lugs 80. The handle portion 10 has parallel sides and is integrally moulded with the gripping portion 12. The gripping portion 12 is circular in plan view and forms a loop at the end 14 of the handle portion 10. The handle portion 10 extends radially outwardly from the base portion 54 in a direction perpendicular to the axle 100. The axle 100, the handle portion 10 and the axis 16 are mutually orthogonal.

The upper face 52 of the body 8 is generally planar and has an aperture 150 located centrally about the axis 16. The aperture 150 has a chamfered upper edge 152 for reasons which will be described below.

Figure 7:
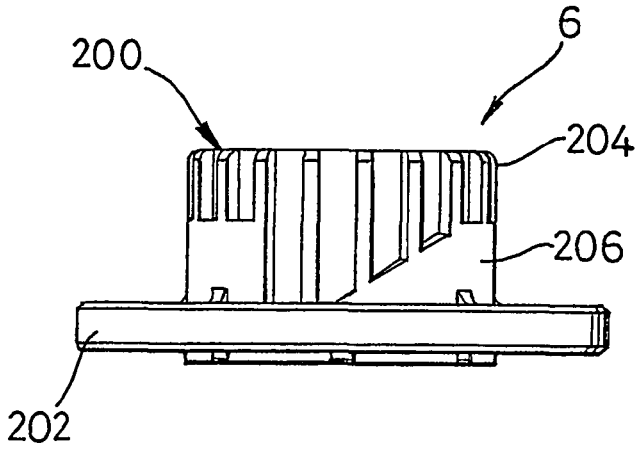
FIG. 7 is a side view of a housing forming part of the mechanism of FIGS. 1 and 2.

The housing 6 of the mechanism 2 is shown in FIGS. 7 to 9. The housing 6 comprises a socket portion 200 and a flange portion 202. The socket portion 200 has a generally cylindrical wall 204 having an outer surface 206 and an inner surface 208. The outer surface 206 has shapings moulded therein which have no specific function. The inner surface 208 has a camming surface 210 formed therein. The camming surface 210 is complementary to the camming surface 62 of the body 8 and comprises a first flat portion 212 which extends circumferentially from an abutment edge 214 to an inclined portion 216. The inclined portion 216 extends upwardly from the first flat portion 212 to a second flat portion 218. The second flat portion 218 extends circumferentially from the inclined portion 216. The formation is repeated in a diametrically opposing manner. Additionally the camming surface 210 has a shoulder 224 located partway along the inclined portion 216. The flange portion 202 has diametrically opposed holes 203 the purpose of which will be described below.

The socket portion 200 has an upper end face 226. A hollow cylindrical peg 228 depends from the upper end face 226 about the axis 16. An outwardly projecting lip 230 is provided at a lower end 232 of the peg 228.

When the mechanism 2 is assembled in a first position, the housing 6 receives the body 8 of the body portion 4. The peg 228 projects through the aperture 150 and the lip 230 cooperates with the lower edge of the aperture 150 in a snap-fitting manner. The camming surface 62 of the body 8 lies against the camming surface 210 of the socket portion 200 such that the abutment edge 58 lies against the abutment edge 214, the first flat portion 64 lies against the first flat portion 212, the inclined portion 66 lies against the inclined portion 216, and the second flat portion 68 lies against the second flat portion 218.

In use, the housing 6 is rigidly fixed to an appliance. Movement of the gripping portion 12 in the direction of arrow A from the first position (as shown in FIG. 2) causes relative rotation between the housing 6 and the body 8. The camming surface 62 moves across the camming surface 210 such that the inclined portion 66 causes the housing 6 to move axially with respect to the body 8. During this movement, the body portion 4 moves through an angle of between 50° and 75°. Subsequently thereto, the first flat portion 212 moves across the second flat portion 68 to allow further rotation of the body portion 4 about the axis 16 through an angle of substantially 45° to 70° with no further axial movement. Further movement in the direction of arrow A is prevented by the abutment of the stop face 70 against the shoulder 224 such that the stop 60 lodges in the shoulder 224. In this configuration, the mechanism 2 is in a second position. The mechanism 2 is prevented from rotating in the direction of arrow B from the first position by the abutment of the abutment edge 214 against the abutment edge 58.

FIGS. 10*a* to 11*b* illustrate the mechanism 2 located in an appliance 400. The appliance 400 as shown has a front surface 402, a base 404, feet 406 and castors 408. The feet 406 are mounted at opposing corners 410 adjacent the front surface 402. The feet 406 are moulded from rubber material. The feet 406 support the appliance 400 on the floor 414. The castors 408 are freely rotatably mounted at the rear 416 of the appliance 400 at opposing corners 418.

In the first position as shown in FIGS. 10*a* and 10*b*, the mechanism 2 is inoperative. The appliance 400 stands stably on the floor 414 being supported both by the feet 406 and the castors 408. The housing 6 is fixedly mounted in the base 404 of the appliance 400 generally centrally of the front surface 402 thereof. The flange portion 202 is fixedly mounted on the base portion 404 by screws fitted through the holes 203 thereof. The handle portion 10 is parallel to the front surface 402. In this first position, the mechanism 2 is generally hidden from view, although a small part of the gripping portion 12 extends beyond the front surface 402 to indicate to the consumer where the mechanism 2 is located.

To bring the mechanism 2 into the second position as shown in FIGS. 11*a* and 11*b*, the consumer pulls the gripping portion 12 outwardly from the front surface 402 thereby rotating the body portion 4 with respect to the housing 6 until the handle portion 10 lies generally perpendicular to the front surface 402. The consumer's action causes the rolling support member 20 to be pressed onto the floor 414 thereby lifting the feet 406 clear of the floor 414. In this position, the appliance 400 is tripodally supported by the rolling support member 20 and the castors 408. The consumer can then manoeuvre and steer the appliance 400 from this lifted position.

To steer the appliance 400, the consumer is able to alter the angle at which the handle portion 10 extends away from the front surface 402 by substantially 25° to either side of the perpendicular direction. Because, in this range of angles, the first flat portion 212 moves across the second flat portion 68, the direction of the handle portion 10 can be altered without lowering the appliance 400 onto its feet 406. The axle 100 on which the rolling support member 20 is mounted is determined by the direction in which the handle portion 10 extends to provide a steering mechanism for the appliance 400. When a pulling force is applied to the gripping portion 12, the rear castors 408 follow the direction of the steering mechanism. This configuration enables the consumer to manoeuvre the appliance 400 in directions other than, but including, forwards and backwards, also having the capability to reposition the appliance 400 should the need arise.

The mechanism 2 is moulded from resilient plastics but could also be made from any other suitable material. The mechanism 2 can be used in a range of appliances particularly domestic appliances, for example washing machines.

The invention is not limited to the precise details of the embodiment described above. The handle portion 10 could be a different shape; for example, it could be curved or arcuate while extending generally radially from the axis 16. The gripping portion 12 could form a natural extension of the handle portion 10 or, alternatively, it could be any suitable shape for gripping. The body 8 could have more than two sets of shapings 56; for example, three equispaced shapings 56 may be incorporated. The snap-fit mechanism holding the socket portion 200 and the body portion 4 together could incorporate means other than the peg 228 and aperture 150 assembly as described above. The flange portion 202 on the housing 6 can be made to suit the appliance 400 and can be fitted to the appliance 400 for example by any suitable means. The socket portion 200 could be non-circular in shape so as to slot into the appliance 400 in a push-fit manner. Other variations may include more than one rolling support member 20 mounted on the axle 100.

What is claimed is:

1. A steering mechanism for an appliance, comprising:

a housing located on a bottom portion of said appliance; a body; at least one rolling support member rotatably mounted on a horizontal axle and rotating in cooperation with the body, the body being connected to and below the housing so as to allow relative rotation between the body and the housing about a vertical axis, the axle being located so as to intersect the vertical axis; and a handle portion connected to the body and extending radially outwardly from the vertical axis.

2. A steering mechanism as claimed in claim 1, wherein the axle lies perpendicular to the radial direction in which the handle portion extends.

3. A steering mechanism as claimed in claim 2, wherein the handle portion extends in a horizontal direction.

4. A steering mechanism as claimed in claim 1, wherein the handle portion has a gripping portion located at a distal end thereof and spaced from the body in the radial direction in which the handle portion extends.

5. A steering mechanism as claimed in claim 1, wherein the housing has a socket portion formed therein, the socket portion and the body comprising opposing camming surfaces configured such that, when the body is rotated about the vertical axis with respect to the socket portion, the camming surfaces co-operate so as to move the housing axially with respect to the body and away from the at least one rolling support member.

6. A steering mechanism for an appliance as claimed in claim 1, wherein the housing is snap-fitted to the body.

7. A steering mechanism as claimed in claim 1, wherein the body is releasably connected to the housing.

8. A steering mechanism as claimed in claim 1, wherein a single rolling support member is mounted on the axle.

9. An appliance comprising a steering mechanism as claimed in claim 1.

10. An appliance as claimed in claim 9, wherein the appliance is a domestic appliance.

11. An appliance as claimed in claim 9, wherein the appliance is a washing machine.

12. An appliance as claimed in claim 9, wherein the housing of the steering mechanism is formed integrally with the appliance.

13. An appliance as claimed in claim 9, wherein the appliance has a generally planar front surface and the steering mechanism is located substantially centrally on the front surface of the appliance.

14. A lifting mechanism for an appliance, comprising:

a generally cylindrical body located on a bottom portion of said appliance having a wall and a longitudinal axis, the longitudinal axis extending in an upward direction;

at least one rolling support member rotatably mounted on an axle beneath the body so that said rolling support member rotates in cooperation with the body; and a housing having a generally cylindrical socket portion with an inner surface configured for receiving the body, wherein the wall and the inner surface comprise opposing camming surfaces configured such that, when the body is rotated about the longitudinal axis with respect to the socket portion, the camming surfaces engage so as to move the housing along the longitudinal axis with respect to the body and away from the at least one rolling support member and the axle is located so as to intersect the longitudinal axis.

15. A lifting mechanism as claimed in claim 14, further comprising a peg located on the housing that projects into the interior of the socket portion along the axis.

16. A lifting mechanism as claimed in claim 15, wherein the body has an aperture located at an upper end thereof for receiving the peg.

17. A lifting mechanism as claimed in claim 14, further comprising a handle portion extending radially outwardly from the body.

18. A lifting mechanism as claimed in claim 14, wherein the opposing camming surfaces each follow a generally helical path.

19. A lifting mechanism for an appliance as claimed in claim 14, wherein the housing is snap-fitted to the body.

20. A lifting mechanism as claimed in claim 14, wherein the body is releasably connected to the housing.

21. A lifting mechanism as claimed in claim 14, wherein a single rolling support member is mounted on the axle.

22. An appliance comprising a lifting mechanism as claimed in claim 14.

23. An appliance as claimed in claim 22, wherein the appliance is a domestic appliance.

24. An appliance as claimed in claim 22, wherein the appliance is a washing machine.

25. An appliance as claimed in claim 22, wherein the housing of the lifting mechanism is formed integrally with the appliance.

26. An appliance as claimed in claim 22, wherein the appliance has a generally planar front surface and the lifting mechanism is located substantially centrally on the front of the appliance.

* * * * *